US008747567B1

(12) United States Patent
Azevedo

(10) Patent No.: US 8,747,567 B1
(45) **Date of Patent: *Jun. 10, 2014**

(54) HARD FLOOR SURFACE CARE PROCESS

(71) Applicant: Steven D. Azevedo, Stockton, CA (US)

(72) Inventor: Steven D. Azevedo, Stockton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/042,672

(22) Filed: Sep. 30, 2013

Related U.S. Application Data

(63) Continuation of application No. 13/535,181, filed on Jun. 27, 2012, now Pat. No. 8,545,635.

(60) Provisional application No. 61/502,075, filed on Jun. 28, 2011.

(51) Int. Cl.
*B08B 7/04* (2006.01)

(52) U.S. Cl.
USPC ..... 134/6; 134/26; 134/27; 134/28; 134/30; 134/35; 134/36; 134/41; 134/42; 510/214; 510/215; 510/238; 510/240; 510/393; 510/434; 510/477; 510/488

(58) Field of Classification Search
CPC ..... B08B 7/04; B08B 3/04; B08B 7/00; C11D 3/2082; C11D 3/2086; C11D 3/386; C11D 7/265; C11D 11/0023; C11D 11/0052; C11D 11/0064; C11D 11/007
USPC ..... 134/6, 26, 27, 28, 30, 34, 35, 36, 41, 134/42; 510/214, 215, 238, 240, 393, 434, 510/477, 488
See application file for complete search history.

(56) References Cited

U.S. PATENT DOCUMENTS

2002/0187914 A1* 12/2002 Massaux et al. ..... 510/417
2012/0234352 A1* 9/2012 Konishi et al. ..... 134/8

* cited by examiner

*Primary Examiner* — Bibi Carrillo
(74) *Attorney, Agent, or Firm* — Dennis A. DeBoo

(57) ABSTRACT

A hard floor surface care process comprising a process of identifying, cleaning, polishing, and protecting manmade and natural stone hard floor surfaces having a single surface or multi-surface quality. The hard floor surface care process comprising an acid reactive or nonreactive hard floor surface identifying process; an emulsifying solution, agitating, and toweling cleaning process; a polishing process utilizing a lubricating solution with a polishing chemistry or pad, and a protecting process utilizing a protecting chemistry selected as a function of the identifying process.

5 Claims, 10 Drawing Sheets

HARD FLOOR SURFACE CARE PROCESS

CROSS-REFERENCE TO RELATED APPLICATIONS

This application is a continuation application of (and claims the benefit of priority under 35 U.S.C. §120 to) U.S. application Ser. No. 13/535,181, filed Jun. 27, 2012, now U.S. Pat. No. 8,545,635, and which is hereby incorporated by reference herein in its entirety and which claims priority under 35 USC Section 119(e) to U.S. Provisional Patent Application No. 61/502,075, filed Jun. 28, 2011, the entire disclosure of which is incorporated herein by reference in its entirety.

FIELD OF THE INVENTION

This invention relates generally to hard floor surface care processes and, in particularly, to a process of identifying, cleaning, polishing, and/or protecting manmade and natural stone hard floor surfaces including hard floor surfaces having a single surface or multi-surface quality such as a hard floor surface having two surface qualities comprised of an array of tile or stone and a grid of grout lines surrounding the tile or stone.

BACKGROUND OF THE INVENTION

A wide variety of hard floor surface care processes, and, in particular, hard floor surface cleaning processes are well-known in the art to accommodate a wide variety of hard floor surfaces. Typical hard floor surfaces include natural wood floors, engineered wood floors, rubber or rubber like floors, laminated floors, linoleum floors, vinyl floors, concrete floors, tile floors generally comprised of ceramic, porcelain, or clay tiles surrounded by grout, and stone floors generally comprised of marble, granite, slate, and travertine which are, in many cases, also surrounded by grout.

Regardless of the hard floor surface, these well-known hard floor surface cleaning processes are generally problematic as a result of their high water, chemical, and energy consumption.

Additionally, these well-known hard floor surface cleaning processes generally employ quantity of liquids that create a low coefficient of friction yielding unsafe foot traffic conditions and decreased process results. The quantity of liquids employed in these well-known hard floor surface cleaning processes also require about 3 feet of the wall from the floor to be taped up or covered to form a protective barrier from thrown fluids.

Furthermore, these well-known hard floor surface cleaning processes generally employ volatile organic stripping compounds, high and low pH detergents and acids and sealants or coatings that yield significant residue or resoiling problems.

Moreover, these well-known hard floor surface cleaning processes are generally lengthy and require rotary or bonnet type machines that employ insufficient physics and long run times which yield inferior results. These rotary or bonnet type machines also employ synthetic pads which lack sufficient absorption properties, load quickly, and spread bio-contaminates.

For the foregoing reasons, there is a need to overcome one or more of the significant shortcomings of the known prior-art as delineated hereinabove.

BRIEF SUMMARY OF THE INVENTION

Accordingly, and in one aspect, an embodiment of the invention ameliorates or overcomes one or more of the significant shortcomings of the known prior art by providing a hard floor surface care process comprising a process of cleaning hard floor surfaces that provides a generally high coefficient of friction/traction while the floor surface is wet/damp; an energy savings/short run duration; orbiting/oscillating floor machine to facilitate mechanical agitation and capillary action on and within the hard floor surface or substrate; an emulsification process utilizing a naturally occurring/renewable source of enzymes and complex fruity acids, buffered pH neutral, in a low volume base of purified and heated water; an extraction of biocontaminates utilizing a naturally occurring/renewable source of 100% cotton cellulose to facilitate maximum absorption and future reuse and eventual recycle; time saving/quick completion; immediately ready to use hard floor surface; and hard floors that can be traversed by pedestrians during service.

In one aspect, an embodiment of the hard floor surface care process comprises an identifying process comprising the steps of: placing a drop of acid onto a hard floor surface; wiping up the acid; and visually inspecting the hard floor surface at the location of the wiped up acid drop wherein a physical change in an appearance of the hard floor surface at the location of the wiped up acid drop indicates an acid reactive hard floor surface and wherein an absence of a physical change in appearance of the hard floor surface at the location of the wiped up acid drop indicates an acid nonreactive hard floor surface.

In another aspect, an embodiment of the hard floor surface care process comprises a cleaning process, said cleaning process comprising: heating a water selected from the group consisting of a buffered distilled water having a pH of about 7 and a buffered soft water having a pH of about 7 to agitate molecule activity of the selected water; mixing the selected water with a chemistry to form a heated cleaning fluid buffered to a pH of about 7, the chemistry comprising alpha and beta hydroxy acids and enzymes; applying the heated cleaning fluid onto a selected area of the hard floor surface to be cleaned; agitating the hard floor surface with the heated cleaning fluid applied thereto for dislodging contaminates from the hard floor surface; and toweling the hard floor surface by interposing a clean, dry cotton cloth between an underside of an oscillating machine and the hard floor surface for absorbing contaminates including the dislodged contaminates while drying the hard floor surface with the cotton cloth being driven by the oscillating machine in an oscillatory motion.

In another aspect, an embodiment of the hard floor surface care process comprises a cleaning process, said cleaning process comprising: heating a water selected from the group consisting of a buffered distilled water having a pH of about 7 and a buffered soft water having a pH of about 7 to agitate molecule activity of the selected water; forming an emulsifying solution by mixing the selected water with a chemistry buffered to a pH of about 7, the chemistry comprising alpha and beta hydroxy acids and enzymes; applying the emulsifying solution onto a selected area of the hard floor surface to be cleaned; agitating the hard floor surface with the emulsifying solution applied thereto for dislodging contaminates from the hard floor surface; and toweling the hard floor surface by interposing a clean, dry cotton cloth between an underside of an oscillating machine and the hard floor surface for absorbing the dislodged contaminates while drying the hard floor surface with the cotton cloth being driven by the oscillating machine in an oscillatory motion. In another aspect, this embodiment can include wherein agitating is by brushing the hard floor surface with the heated cleaning fluid applied thereto for dislodging contaminates from the hard floor surface. In another aspect, this embodiment can include wherein agitating is by pad agitation comprising interposing a rubber or rubber like pad between an underside of the oscillating machine and over the heated cleaning fluid applied on the hard floor surface with the pad being driven by the oscillating machine in an oscillatory motion for dislodging contaminates from the hard floor surface.

In another aspect, an embodiment of the hard floor surface care process comprises a polishing process, said polishing process comprising: providing a water selected from the group consisting of distilled water and soft water; adding a silicate buffer and alpha and beta hydroxy acids to the selected water to form a lubricating solution having a pH of about 7; selecting a polishing chemistry from the group consisting of a first portion of Nano-crystal diluted with a second portion of lubricating solution and a 100% concentrated gel paste Nano crystal; applying the lubricating solution onto the cleaned hard floor surface; applying the selected polishing chemistry onto the cleaned hard floor surface sprayed with the lubricating solution; toweling the applied selected polishing chemistry and the lubricating solution by interposing a clean, dry microfiber cloth between an underside of an oscillating machine and the hard floor surface for polishing the hard floor surface with the microfiber cloth being driven by the oscillating machine in an oscillatory motion; and repeating the polishing steps until a desired polished look is obtained.

In a further aspect, an embodiment of the hard floor surface care process comprises a polishing process, said polishing process comprising: providing a water selected from the group consisting of distilled water and soft water; adding a silicate buffer and alpha and beta hydroxy acids to the selected water to form a lubricating solution having a pH of about 7; applying the lubricating solution onto the cleaned hard floor surface; polishing the hard floor surface by interposing a rubber or rubber like pad between an underside of the oscillating machine and over the applied solution on the hard floor surface with the pad being driven by the oscillating machine in an oscillatory motion for polishing the hard floor surface; toweling the hard floor surface by interposing a clean, dry microfiber cloth between an underside of the oscillating machine and the hard floor surface with the microfiber cloth being driven by the oscillating machine in an oscillatory motion for further polishing the hard floor surface with the microfiber cloth and absorbing the presence of applied solution. Repeat process until a desired polished look is obtained.

In yet another aspect, an embodiment of the hard floor surface care process comprises a protecting process, said protecting process comprising: selecting, as a function of the identifying step, a protecting chemistry from the group consisting of a water based carrier combined with a fluoropolymer and a petro solvent based carrier combined with a fluoropolymer wherein the protecting chemistry in the form of the water based carrier combined with the fluoropolymer is selected when the hard floor surface is identified as acid nonreactive and wherein the protecting chemistry in the form of the petro solvent based carrier combined with the fluoropolymer is selected when the hard floor surface is identified as acid reactive; applying the selected protecting chemistry with a step selected from the group consisting of toweling on the selected protecting chemistry and spraying on the selected chemistry; and toweling the applied selected protecting chemistry by interposing a clean, dry microfiber or cotton cloth between an underside of an oscillating machine and the hard floor surface with the microfiber or cotton cloth being driven by the oscillating machine in an oscillatory motion.

Hence, an embodiment of the hard floor surface care process provides a process of identifying, cleaning, polishing, and protecting manmade and natural stone hard floor surfaces including hard floor surfaces having a single surface quality or a multi-surface quality such as a hard floor surface having two surface qualities comprised of an array of tile or stone and a grid of grout lines surrounding the tile or stone.

Hard floor surfaces include all types of natural rubber and synthetic rubber (rubber like) materials such as a synthetic material in the form of EPDM (ethylene propylene diene monomer (M-class) rubber), a SBR (Styrene-Butadiene Rubber), Neoprene, Nitrile, etc or such as a natural rubber.

Rubber or rubber like compound surface floors are difficult to clean because of their nature to grab debris and to have an affinity to oil based compounds. One example of this of this hard floor surface is illustrated in a walking track made of an engineered walking rubber compound.

To ameliorate or overcome this difficulty, an embodiment of the hard floor surface care process provides an emulsifying solution, pad agitating, and toweling cleaning process as delineated hereinabove and hereinbelow.

In light of the above, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
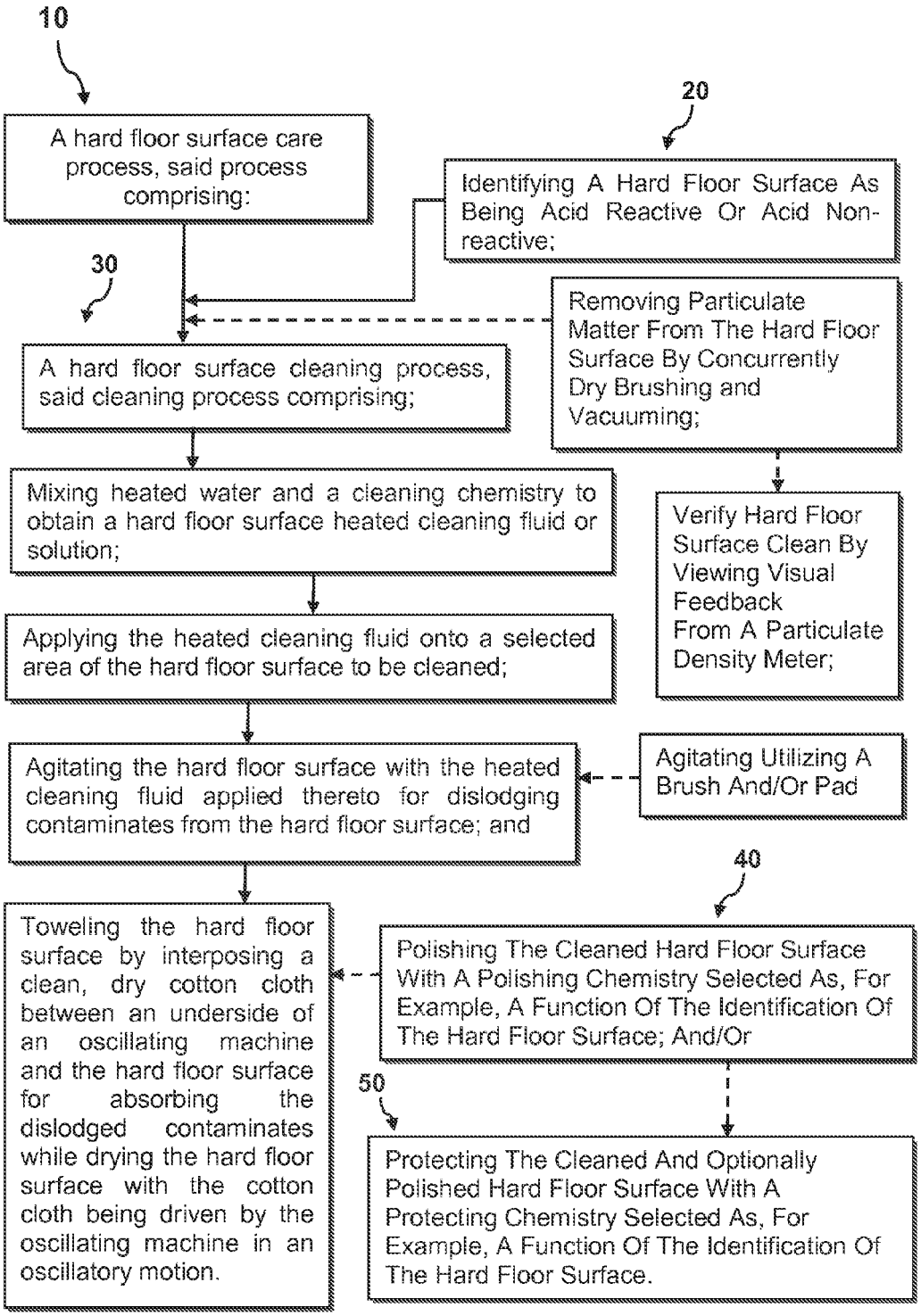
FIG. 1 is a general functional flow diagram of an embodiment of a hard floor surface care process comprising identifying, cleaning, polishing, and protecting manmade and natural stone hard floor surfaces including hard floor surfaces having a single or multi-surface quality.

Turning now to the Drawings, wherein like numbers denote like parts throughout the several views, FIG. 1 illustrates a general functional flow diagram of an embodiment of a hard floor surface care process 10 comprising a process of identifying, cleaning, polishing, and protecting manmade and natural stone hard floor surfaces including hard floor surfaces having a single surface quality or a multi-surface quality such as a hard floor surface having two surface qualities comprised of an array of tile or stone and a grid of grout lines surrounding the tile or stone.

Overview

Referring to FIG. 1, an embodiment of the hard floor surface care process 10 includes an identifying process 20 for identifying a hard floor surface that is to be cared for as having an acid reactive or acid nonreactive characteristic as well as identifying the porosity, absorption, and relative hardness/softness characteristics of the hard floor surface.

Once an operator determines the characteristics of the hard floor surface, then the operator proceeds with a cleaning process 30 as well as an optional polishing process 40 and/or an optional protecting process 50.

Prior Preparation

In one embodiment, the hard floor surface care process 10 includes steps of removing loose particulate matter from the hard floor surface by concurrently dry brushing and vacuuming the hard floor surface while being provided with visual feedback from a particulate density meter for verifying that a desired level of hard floor surface cleanliness is obtained.

Identifying Process 20

Figure 2:
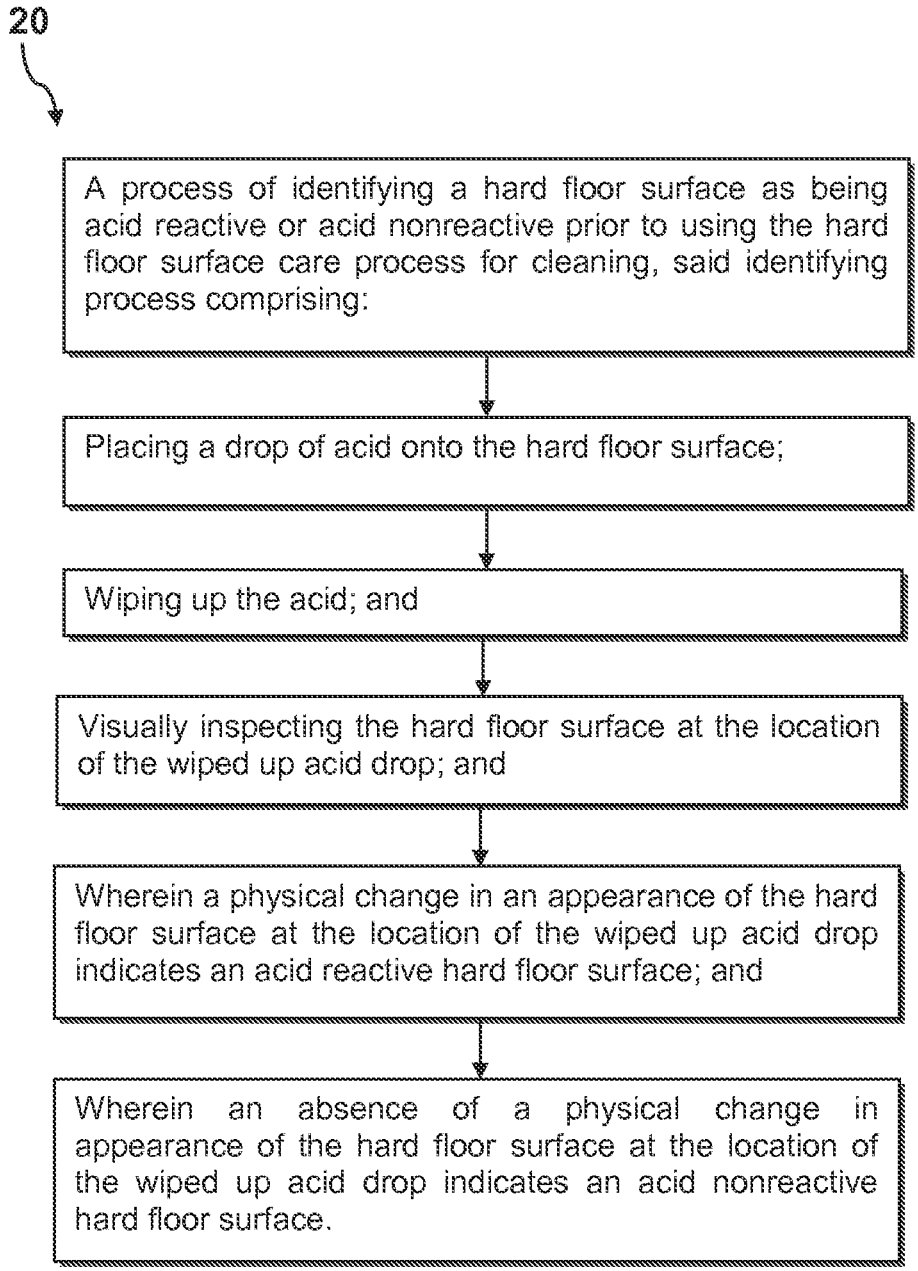
FIG. 2 is a functional flow diagram of an embodiment of a hard floor surface identifying process.

Referring now to FIG. 2, an embodiment of the hard floor surface care process 10 comprises an identifying process 20 comprising: identifying a hard floor surface as being acid reactive or acid nonreactive by placing a drop of acid onto an inconspicuous location of a hard floor surface, wiping up the acid, and visually inspecting the hard floor surface at the location of the wiped up acid drop wherein a physical change in visual appearance (shine, etching, et cetera) of the hard floor surface at the location of the wiped up acid drop indicates an acid reactive hard floor surface and wherein an absence of a physical change in visual appearance of the hard floor surface at the location of the wiped up acid drop indicates an acid nonreactive hard floor surface.

Generally, 20 drops are equal to about 1 milliliter, so one drop is equal to about 0.05 ml. Additionally, and in one embodiment, the acid can be in the form of, but not limited to, hydrochloric or phosphoric acid.

Additionally, and in general, hard floor surfaces are provided in a variety of different materials with a variety of hard floor surfaces having mineral content that basically comes from different regions of the world and that has different properties. Thus, identifying a hard floor surface as being acid reactive or acid nonreactive quickly tells one what type of hard floor surface that one is working with. Although a visual inspection can sometimes be used to determine what type of hard floor surface one is working with, it is not always accurate. For example, marble is usually calcium based, but depending on where it is mined, it can have some silica in it thereby resulting in a different reaction.

Thus, the identifying process delineated above is needed to know what type of reaction you are going to have with the pH level of a specific cleaning, polishing, or protecting product. In particular, if the identifying process delineated above results in an acid reaction, then one does not want to get into the acid range with cleaning, polishing, and protecting solutions or slurries because of the potential of damaging to the hard floor surface therewith. Thus, the above delineated identifying process quickly tells one whether the surface is going to react to anything acidic or not and there is hardly any in between.

Furthermore, hard floor surfaces may have generally two surface qualities comprised of an array of tile or stone and a grid of grout lines surrounding the tile or stone completing the surface. Thus, one has to concurrently deal with the tile or stone and the grout. If the acid drop falls on the grout and there is no reaction, then the grout is potentially a synthetic polymer based grout or it is sealed. If the acid drop falls on the grout and there is an instant reaction, then the grout is being identified as Portland cement either sanded (generally used with porcelain or ceramics) or non-sanded (generally used with natural stones).

Moreover, the above delineated identifying process also reveals information about the absorption and porosity of the hard floor surface or substrate because every different surface has an absorption and porosity. On porcelain, ceramic, sealed clay, linoleum, and vinyl the liquid drop will just sit on top. On limestone, granite, marble, terrazzo, travertine, depending on the porosity of the stone, the liquid will, in combination, either damage the surface or etch the surface and also potentially disappear into the surface.

Hence, the above delineated identifying step reveals if the hard floor surface is reactive to the acid thereby providing information about how the hard floor surface will react to the pH level of a specific cleaning, polishing, or protecting product and also the above delineated identifying step reveals the absorption and porosity of the hard floor surface thereby providing information about how much water or volume will be required in later processes of, for example, cleaning and polishing.

Hard floor surfaces also come in a variety of forms with some surfaces being acid nonreactive when sealed and acid reactive when unsealed. There are also manmade hard floor surfaces that mimic the look of natural stones and are not easily identifiable. Thus, the above delineated identifying step or process provides a means for obtaining the information needed to properly care for these hard floor surfaces.

In general, hard floor surfaces include natural wood floors, engineered wood floors, rubber or rubber like floors, laminated floors, linoleum floors, vinyl floors, concrete floors, tile floors generally comprised of ceramic, porcelain, or clay tiles surrounded by grout, and stone floors generally comprised of marble, granite, slate, and travertine which are, in many cases, also surrounded by grout.

Examples of synthetic hard floor surfaces include linoleum, laminates, and rubbers of all types such as a synthetic material in the form of EPDM (ethylene propylene diene monomer (M-class) rubber), a SBR (Styrene-Butadiene Rubber), Neoprene, Nitrile, etc or such as a natural rubber.

The only commercial natural rubber source in the world is the Brazilian Rubber Tree, *Hevea brasiliensis* (Hevea) grown almost exclusively in Southeast Asia.

It should be noted that the acid reactive/nonreactive acid test is not used on a rubber compound floor.

Cleaning Process 30

Referring back to FIG. 1, an embodiment of the hard floor surface care process 10 comprises a cleaning process 30 comprising:

1) Mixing heated water and a cleaning chemistry to obtain a hard floor surface heated cleaning fluid or solution;

2) Applying the heated cleaning fluid onto a selected area of the hard floor surface to be cleaned;

3) Agitating (utilizing a brush and/or a rubber or rubber like pad) the hard floor surface with the heated cleaning fluid applied thereto for dislodging contaminates from the hard floor surface; and 4) Toweling the hard floor surface by interposing a clean, dry cotton cloth between an underside of an oscillating machine and the hard floor surface for absorbing the dislodged contaminates while drying the hard floor surface with the cotton cloth being driven by the oscillating machine in an oscillatory motion.

Figure 3:
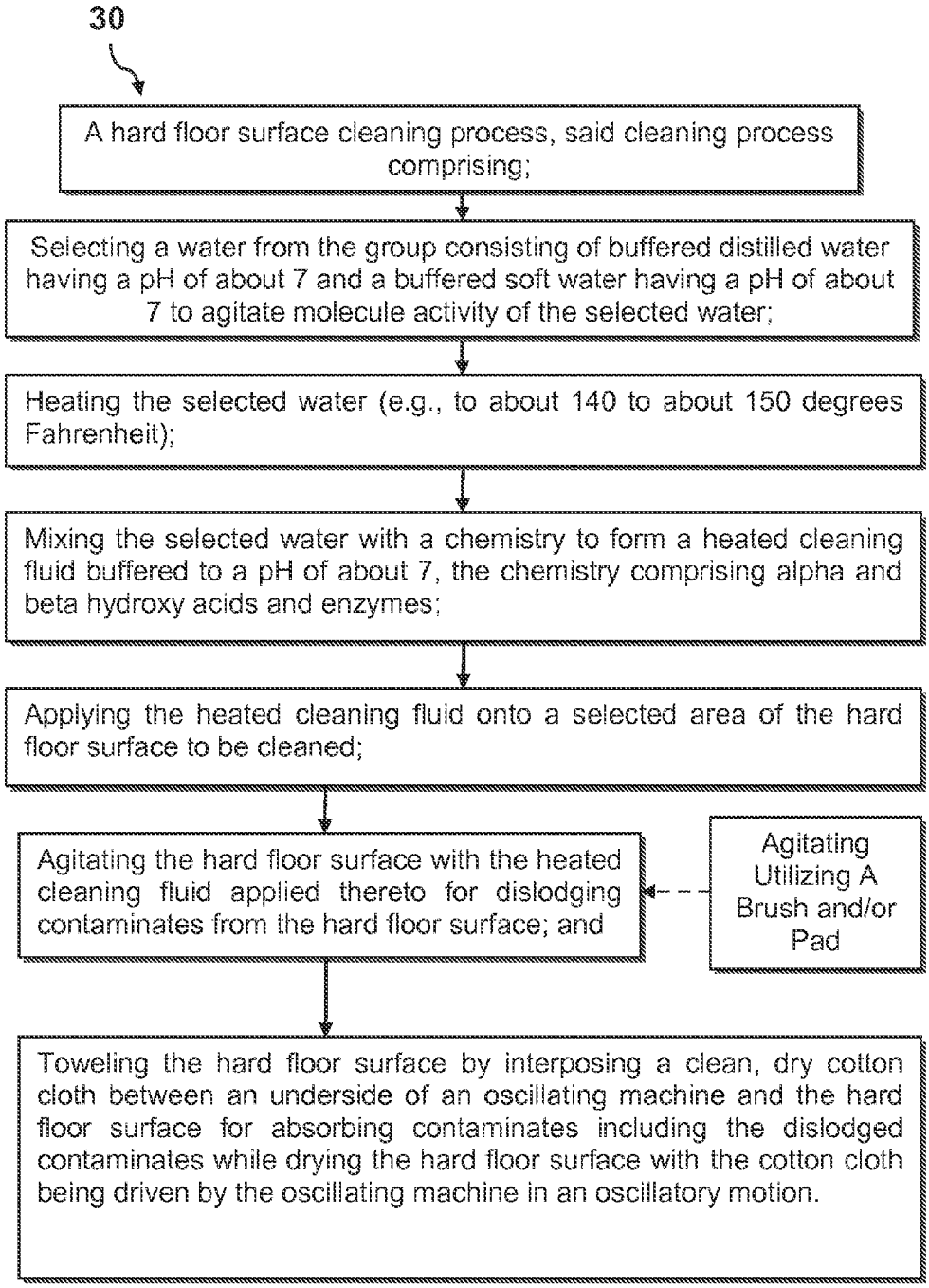
FIG. 3 is a functional flow diagram of an embodiment of a hard floor surface cleaning process.

Referring now to FIG. 3, another embodiment of the hard floor surface care process 10 comprises a cleaning process 30 comprising:

1) Selecting a water from the group consisting of buffered distilled water having a pH of about 7 and a buffered soft water having a pH of about 7 to agitate molecule activity of the selected water;

2) Heating the selected water (e.g., to about 140 to about 150 degrees Fahrenheit);

3) Mixing the selected heated water with a chemistry to form a heated cleaning fluid buffered to a pH of about 7, the chemistry comprising alpha and beta hydroxy acids and enzymes;

4) Applying the heated cleaning fluid onto a selected area of the hard floor surface to be cleaned by, for example, putting the heated cleaning fluid into a pump sprayer and spraying the heated cleaning fluid onto a selected area of the hard floor surface to be cleaned;

5) Agitating (utilizing a brush and/or pad) the sprayed hard floor surface in, for example, four orthogonally different directions for dislodging contaminates from the sprayed hard floor surface (there may be a situation identified that deems this agitation step as optional);

6) Toweling the sprayed and agitated hard floor surface by interposing a clean, dry cotton cloth between an underside of an oscillating machine and the hard floor surface for creating a coefficient of friction between the cotton cloth and the hard floor surface for absorbing contaminates including the dislodged contaminates while drying the sprayed and agitated hard floor surface with the cotton cloth being driven by the oscillating machine in an oscillatory motion; and 7) Periodically viewing the cotton cloth contaminate collection which typically starts out as a white cloth which turns almost black depending on contaminates collection and replacing the cotton cloth when dirty and repeating the toweling step, which is referred to as passes, until the hard floor surface is cleaned as desired.

In one embodiment, the applying step of the cleaning process 30 applies about 0.5 ounces of the cleaning fluid per square foot of the selected area of the hard floor surface to be cleaned while the cleaning fluid is still heated and adjust this amount as a function of the hard floor surface porosity.

Figure 4A:
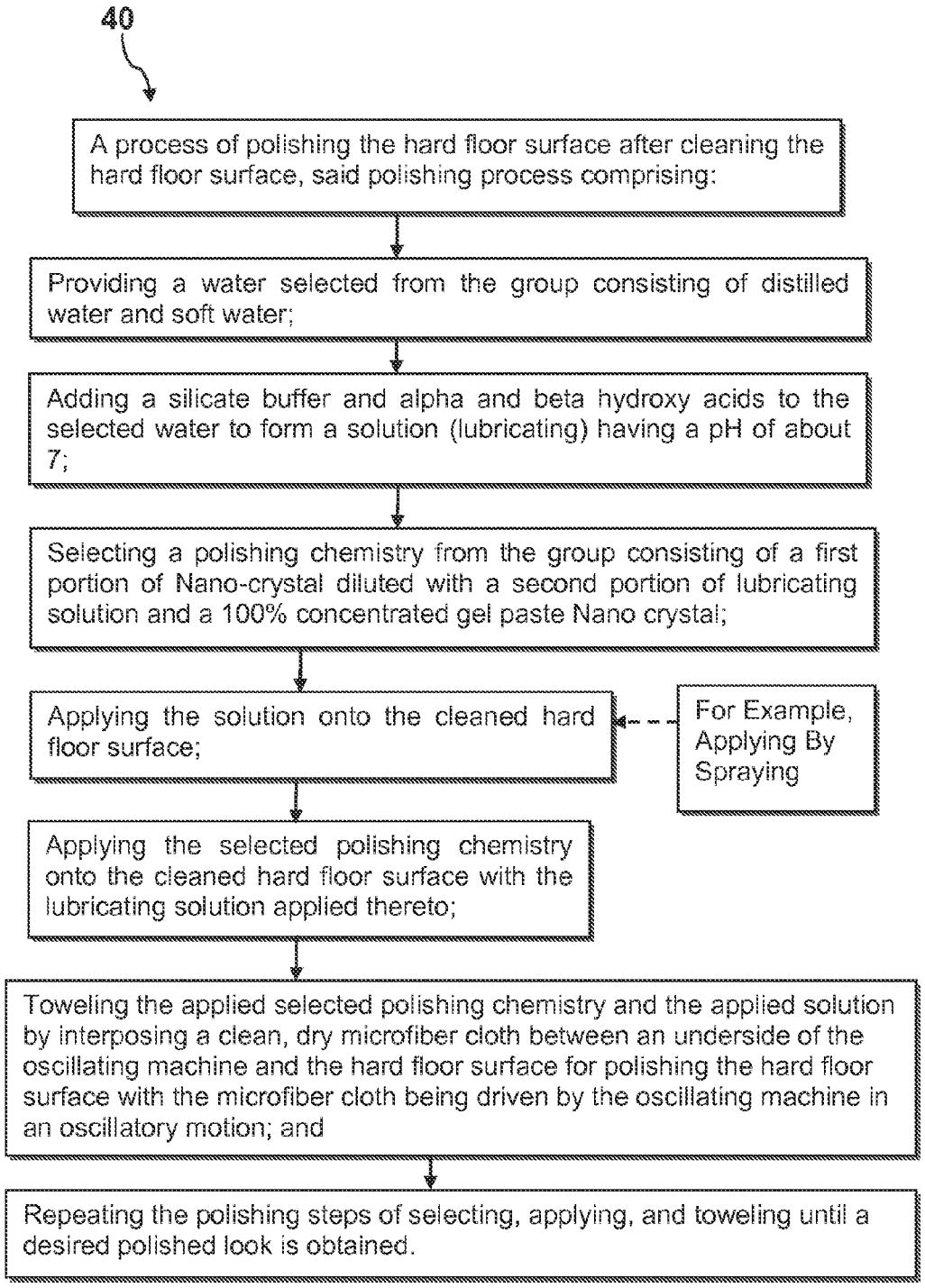
FIG. 4A is a functional flow diagram of an embodiment of a hard floor surface polishing process.

Polishing Process 40 (FIG. 4A)

Referring now to FIG. 4A, an embodiment of the hard floor surface care process 10 comprises a polishing process 40 for polishing the hard floor surface after cleaning the hard floor surface, said polishing process comprising:

1) Providing a water selected from the group consisting of distilled water and soft water;

2) Adding a silicate buffer and alpha and beta hydroxy acids to the selected water to form a solution (lubricating) having a pH of about 7;

3) Selecting a polishing chemistry from the group consisting of a first portion of Nano-crystal diluted with a second portion of the solution and a 100% concentrated gel paste Nano crystal;

4) Applying by, for example, spraying the solution onto the cleaned hard floor surface;

5) Applying the selected polishing chemistry onto the cleaned hard floor surface sprayed with the solution;

6) Toweling the applied selected polishing chemistry and the applied solution by interposing a clean, dry microfiber cloth between an underside of the oscillating machine and the hard floor surface for polishing the hard floor surface with the microfiber cloth being driven by the oscillating machine in an oscillatory motion; and 7) Repeating the polishing steps of selecting, applying, and toweling until a desired polished look is obtained.

In one embodiment, the solution applying step of the polishing process 40 applies about 0.2 ounces of the solution per square foot of the cleaned hard floor surface to be polished and adjust this amount as a function of the hard floor surface porosity.

Figure 4B:
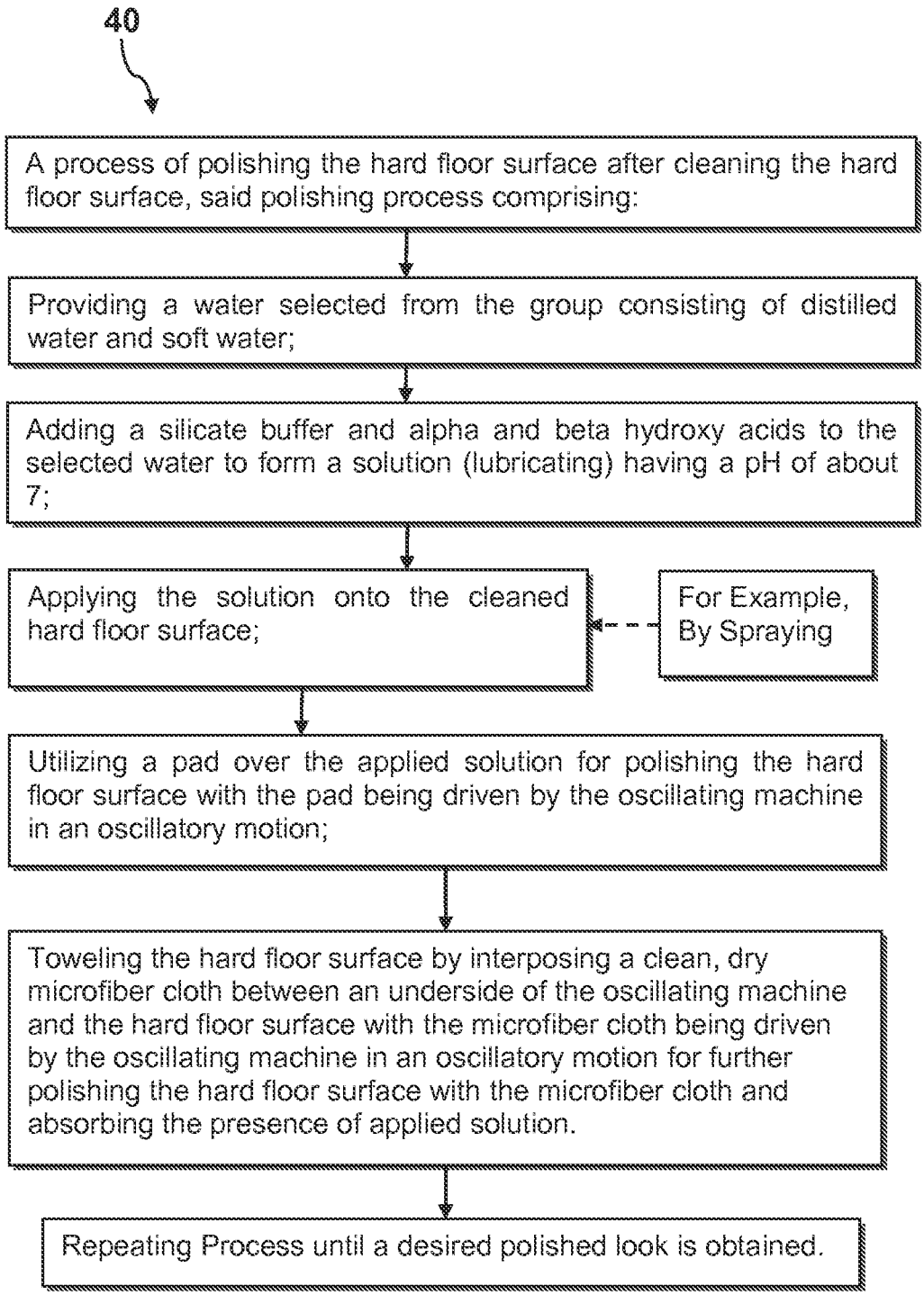
FIG. 4B is a functional flow diagram of another embodiment of a hard floor surface polishing process.

Polishing Process 40 (FIG. 4B)

Referring now to FIG. 4B, and in another embodiment, the hard floor surface care process 10 comprises a polishing process 40 for polishing the hard floor surface after cleaning the hard floor surface, said polishing process comprising:

1) Providing a water selected from the group consisting of distilled water and soft water;

2) Adding a silicate buffer and alpha and beta hydroxy acids to the selected water to form a lubricating solution having a pH of about 7;

3) Applying the lubricating solution onto the cleaned hard floor surface;

4) Polishing the hard floor surface by interposing a rubber or rubber like pad between an underside of the oscillating machine and over the applied solution on the hard floor surface with the pad being driven by the oscillating machine in an oscillatory motion for polishing the hard floor surface; and 5) Toweling the hard floor surface by interposing a clean, dry microfiber cloth between an underside of the oscillating machine and the hard floor surface with the microfiber cloth being driven by the oscillating machine in an oscillatory motion for further polishing the hard floor surface with the microfiber cloth and absorbing the presence of applied solution. This process is repeated until the desired polished look is obtained.

In one embodiment, the lubricating solution applying step of the polishing process 40 applies about 0.2 ounces of the lubricating solution per square foot of the cleaned hard floor surface to be polished and adjust this amount as a function of the hard floor surface porosity.

Protecting Process 50

Figure 5:
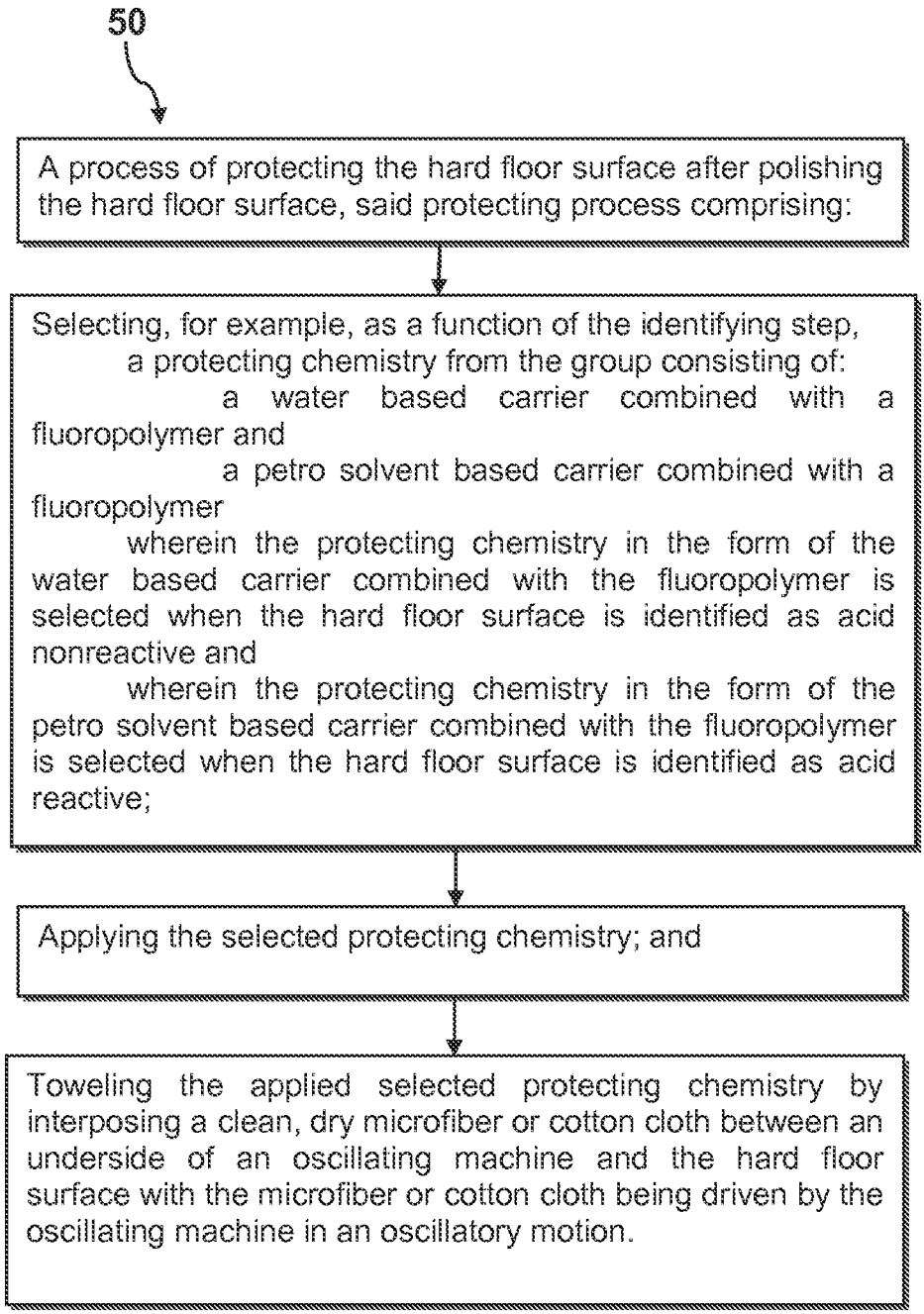
FIG. 5 is a functional flow diagram of an embodiment of a hard floor surface protecting process.

Referring now to FIG. 5, an embodiment of the hard floor surface care process 10 comprises a protecting process 50 of protecting the hard floor surface after polishing the hard floor surface, the protecting process 50 comprising:

1) Selecting, as a function of the identifying step, a protecting chemistry from the group consisting of a water based carrier combined with a fluoropolymer and a petro solvent based carrier combined with a fluoropolymer wherein the protecting chemistry in the form of the water based carrier combined with the fluoropolymer is selected when the hard floor surface is identified as acid nonreactive and wherein the protecting chemistry in the form of the petro solvent based carrier combined with the fluoropolymer is selected when the hard floor surface is identified as acid reactive;

2) Applying the selected protecting chemistry with a step selected from the group consisting of toweling on the selected protecting chemistry and spraying on the selected chemistry; and 3) Toweling the applied selected protecting chemistry by interposing a clean, dry microfiber or cotton cloth between an underside of an oscillating machine and the hard floor surface with the microfiber or cotton cloth being driven by the oscillating machine in an oscillatory motion. This process is repeated as desired.

Machinery and Materials

Figures 6, 7:
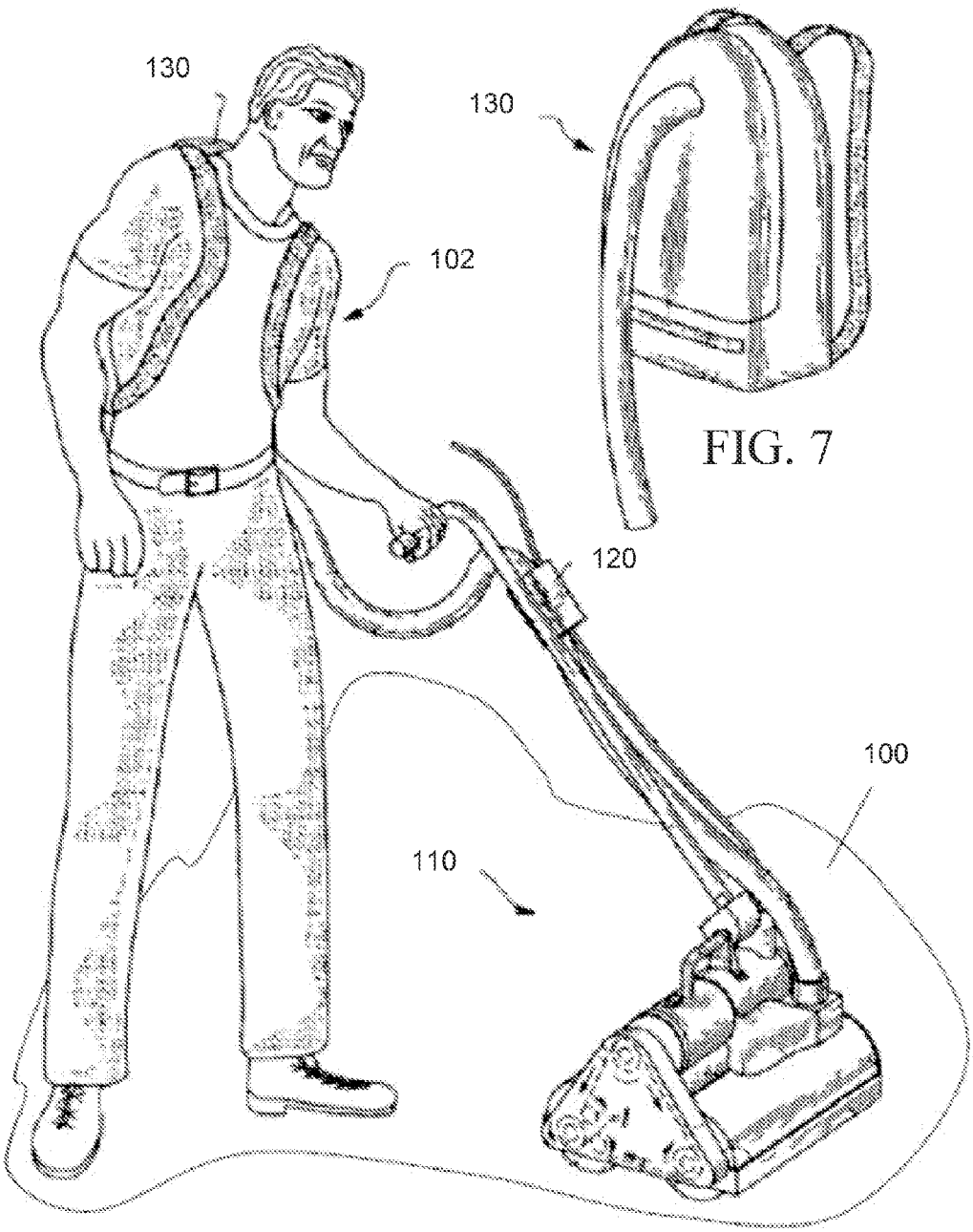
FIG. 6 is a perspective view of an embodiment of a drybrush-vacuum unit or machine and an embodiment of use of the drybrush-vacuum unit by an operator.
FIG. 7 is a perspective view of an embodiment of a vacuum backpack which is an optional part of the drybrush-vacuum unit or machine shown in FIG. 6.

Referring now to FIGS. 6 and 7, and in one embodiment, a drybrush-vacuum machine 110 having a particle density sensor detector 120 and backpack vacuum source 130 as delineated in detail in Applicant's U.S. Pat. No. 6,030,464, which is incorporated herein by reference in its entirety, is employed as the machine referenced herein for use by the operator 102 for concurrently dry brushing and/or vacuuming hard floor surface 100 while dry in order to remove generally loose and dry contamination embodied as particulate matter from the hard floor surface and for continuously sensing particulate matter density during dry brushing and vacuuming and displaying the density of the particulate matter being vacuumed from the hard floor surface during vacuuming to signal comparative cleanliness.

Figure 8:
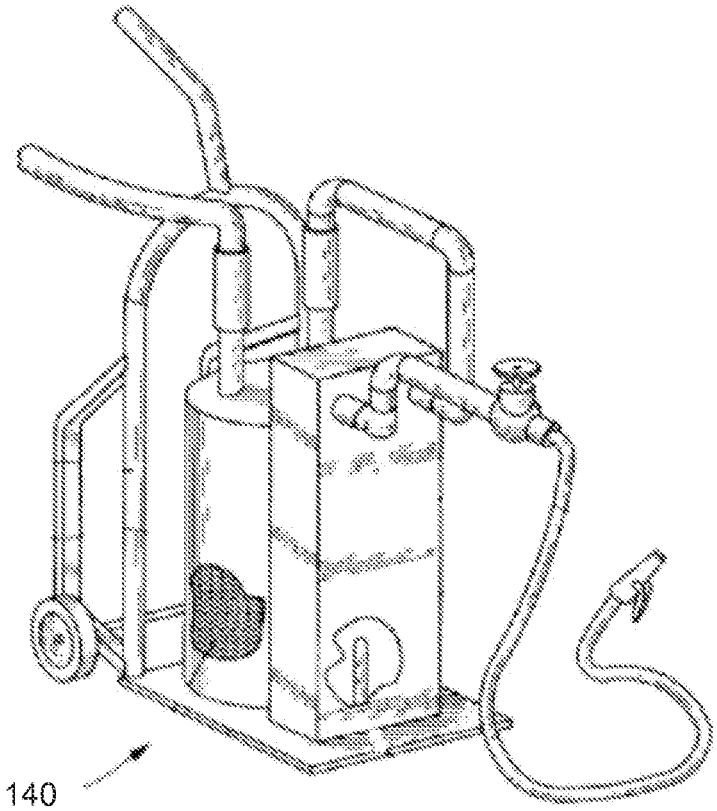
FIG. 8 is a perspective view of an embodiment of a portable water heating and purification unit.

Referring now to FIG. 8, and in one embodiment, a portable cleaning fluid or solution preparation apparatus 140 generally comprised of a cart which bears a portable water treatment and heating apparatus having a water purifier and a water heater as delineated in detail in Applicant's U.S. Pat. No. 6,030,464, which is incorporated herein by reference in its entirety, is employed for the machine referenced herein for heating the water selected from the group consisting of buffered distilled water having a pH of about 7 and buffered soft water having a pH of about 7 to agitate molecule activity of the selected water.

In one embodiment, the step of selecting the water from the group consisting of buffered distilled water having a pH of about 7 and buffered soft water having a pH of about 7 is done as a function of not only the above delineated identification process 20, but also in combination with what condition the hard floor surface appears to be in wherein buffered distilled water can be defined as aggressive, it will pull a molecule or mineral, and wherein buffered soft water can be defined as passive.

Accordingly, the operator 102 has two different options, if the hard floor surface is not in very bad shape a passive type of cleaning (soft water) is preferably performed and if floor is not maintained well, has a lot of buildup, et cetera, an aggressive type of cleaning (DI water) will be performed.

As noted, and in one embodiment, the selection also takes into consideration the results of the above delineated identification process 20.

Figure 9:
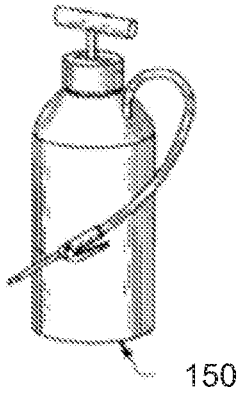
FIG. 9 is a perspective view of an embodiment of a pump sprayer.
Figure 10:
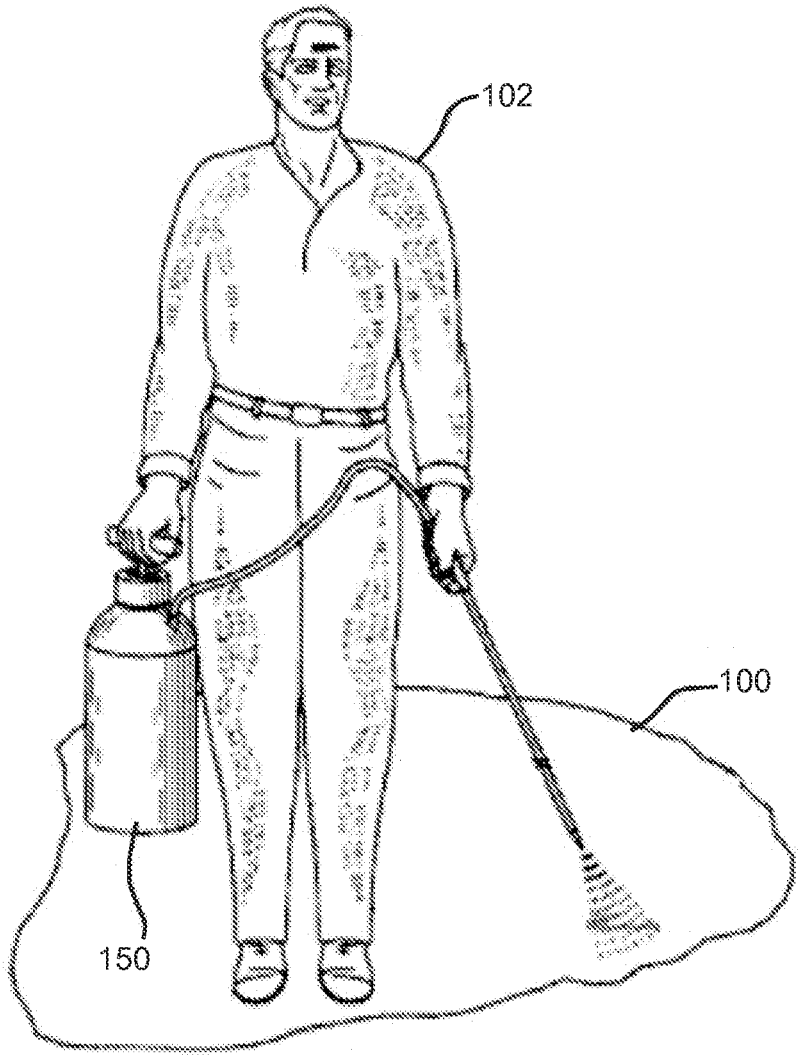
FIG. 10 is a perspective view showing an embodiment of use of the pump sprayer by the operator.

Referring now to FIGS. 9 and 10, and in one embodiment, a portable pump sprayer 150 delineated in detail in Applicant's U.S. Pat. No. 6,030,464, which is incorporated herein by reference in its entirety, is employed for containing the mixture of the selected heated water that is folded into a chemistry comprising alpha and beta hydroxy acids and enzymes to form the heated cleaning fluid or solution buffered to a pH of about 7.

The introduction of Ion Exchange Water acts as a Catalyst for both anhydrous versions of the enzymes (NExZyme) and the Alpha/Beta Hydroxy Acids. Once mixed together, the shelf life is approximately 10 hrs of activity, dissipating at a rate 10% per hour. Modified H2O plus the enzymes (NExZyme) plus Alpha/Beta Hydroxy Acids equal compounded emulsifying solution.

The portable pump sprayer 150 is further employed for spraying the heated cleaning fluid or solution onto the selected area of the hard floor surface to be cleaned as illustrated in FIG. 10.

Preferable heat, emulsification, suspension and absorption is obtained when mixing the selected heated water with the alpha and beta hydroxy acids and enzymes to form the heated cleaning fluid or solution buffered to a pH of about 7.

In one embodiment, the dry-brush part of the dry-brush-vacuum machine 110 is employed for agitating by brushing the sprayed hard floor surface in, for example, four orthogonally different directions for dislodging contaminates from the sprayed hard floor surface.

Figure 11:
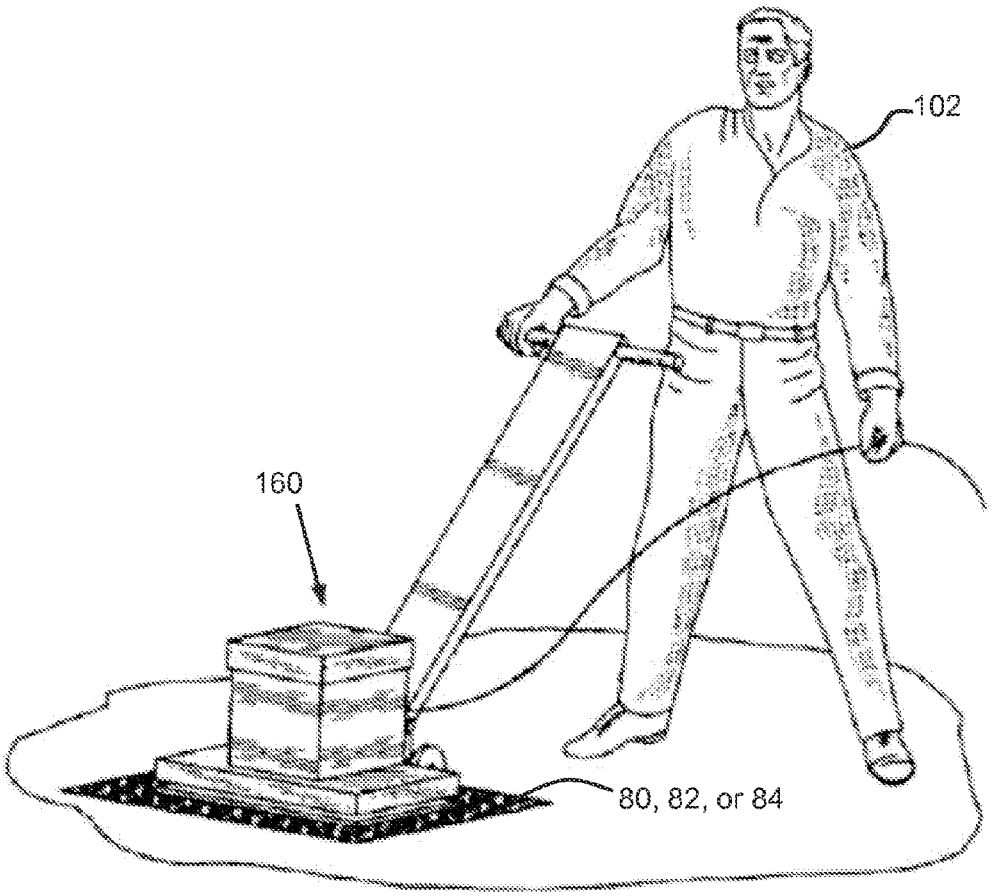
FIG. 11 is a perspective view of an embodiment of a toweling machine and an embodiment of use of the toweling machine by the operator by interposing a microfiber cloth, a cotton cloth, or a rubber or rubber like pad between an underside of an oscillating machine and the hard floor surface with the microfiber cloth, cotton cloth, or rubber or rubber like pad being driven by the oscillating machine in an oscillatory motion.

Referring to FIG. 11, and in one embodiment, a toweling machine 160 as delineated in detail in Applicant's U.S. Pat. No. 6,030,464, which is incorporated herein by reference in its entirety, is employed for the oscillating unit or machine for toweling the sprayed and agitated hard floor surface by interposing a clean, dry cotton cloth 80 between an underside of the oscillating machine and the hard floor surface for absorbing the contaminates including the dislodged contaminates while drying the sprayed and agitated hard floor surface with the cotton cloth being driven by the oscillating machine in an oscillatory motion.

In another embodiment, and referring to FIG. 11, the toweling machine 160 is employed for the oscillating unit or machine for agitating by interposing a rubber or rubber like pad 84 between an underside of the oscillating machine and over the applied solution on the hard floor surface (sprayed hard floor surface) with the rubber or rubber like pad 84 being driven by the oscillating machine in an oscillatory motion for dislodging contaminates from the sprayed hard floor surface.

In another embodiment, and referring to FIG. 11, the toweling machine 160 is employed for the oscillating unit or machine for polishing by interposing a microfiber/polyamide cloth 82 or a pad 84 between an underside of the oscillating machine and the hard floor surface with the microfiber/polyamide cloth 82 or the rubber or rubber like pad 84 being driven by the oscillating machine in an oscillatory motion for polishing the hard floor surface.

Microfiber/Polyamide Cloth 82

One example of the microfiber/polyamide cloth 82 is sold under part number KS4FBZ, sold under the TRADE NAME: KARMALYE, by Wuxi Haodi Microfiber Fabric Co., Ltd., No. 110, Area B, Yangming High Technology And New Technology Garden, Nanchang District, Wuxi, Jiangsu, China.

Rubber or Rubber Like Pad 84

One example of the rubber or rubber like pad 84 utilized for cleaning/stripping is sold under part number: FN520001812 and under part name: Scotch-Brite Sienna Diamond Floor Pad Plus by 3M (3M Corporate Headquarters, 3M Center, St. Paul, Minn. 55144).

One example of the rubber or rubber like pad 84 utilized for cleaning/stripping is sold under part number: FN520001846 and under part name: Scotch-Brite Purple Diamond Floor Pad Plus by 3M (3M Corporate Headquarters, 3M Center, St. Paul, Minn. 55144).

Chemistry (Identifying Chemistry)

In one embodiment, the hard floor surface care process 10 comprises an identifying process 20 for identifying the hard floor surface as being acid reactive or acid nonreactive prior to cleaning by: placing a drop of acid onto the hard floor surface; wiping up the acid; and visually inspecting the hard floor surface at the location of the wiped up acid drop wherein a physical change in an appearance of the hard floor surface at the location of the wiped up acid drop indicates an acid reactive hard floor surface and wherein an absence of a physical change in appearance of the hard floor surface at the location of the wiped up acid drop indicates an acid nonreactive hard floor surface. One drop of acid is about 0.05 milliliter (ml).

Typically, the acid is selected from the group consisting of hydrochloric acid and phosphoric acid.

In one example, the acid reactive hard floor surface defines a natural stone hard floor surface. And, the acid nonreactive hard floor surface defines a manmade hard floor surface.

Chemistry (Heated Cleaning Fluid or Solution Chemistry)

In one embodiment, the hard floor surface care process 10 comprises a cleaning process, said cleaning process comprising:

1) Heating (such as from about 140 to about 150 degrees Fahrenheit) a water selected from the group consisting of a buffered distilled water having a pH of about 7 and a buffered soft water having a pH of about 7 to agitate molecule activity of the selected water.

2) Then, mixing the selected water with a chemistry to form a heated cleaning fluid buffered to a pH of about 7, the heated cleaning fluid comprising:

(a) from about 96.5 to about 98.1% by volume of the selected water;

(b) from about 0.8 to about 1.5% by volume of enzymes (NExzyme);

(c) from about 0.3 to about 0.8% by volume of alpha hydroxy acid; and (d) from about 0.4 to about 0.7% by volume of beta hydroxy acid; and 3) Applying by spraying the heated cleaning fluid onto a selected area of the hard floor surface to be cleaned; and 4) Agitating the sprayed hard floor surface for dislodging contaminates from the sprayed hard floor surface; and 5) Toweling the sprayed and agitated hard floor surface by interposing a clean, dry cotton cloth between an underside of an oscillating machine and the sprayed and agitated hard floor surface for absorbing the contaminates while drying the sprayed and agitated hard floor surface with the cotton cloth being driven by the oscillating machine in an oscillatory motion for defining a cleaned hard floor surface.

Chemical Examples (Cleaning Fluid or Solution Chemistry)

Enzymes

One example of the Enzymes is sold under part number 2LXE and under the TRADE NAME: BIO-DEX-AC Consonance Solutions Inc., No. 678, Pace City 2, Sector 37, Bangalore, Kamataka, India, 500032.

Alpha and Beta Hydroxy Acids

One example of the Alpha and Beta Hydroxy Acids are respectively sold under part numbers SP1A and SP1B and under the TRADE NAMES: SCIPHAR A & SCIPHAR B by Tianjin Pharma Tech Co., Ltd., 111 HuangHai Road 1EDA Tianjin, P. R. China.

Chemistry (Spray and Polish Chemistry)

In one embodiment, the hard floor surface care process 10 comprises a polishing process for polishing the hard floor surface after cleaning, said polishing process comprising:

1) providing a spray solution comprised of:

(a) from about 96.3 to about 97.9% by volume of the selected water;

(b) from about 1.1 to about 2.0% by volume of the silicate buffer;

(c) from about 0.5 to about 1.1% by volume of alpha hydroxy acid;

(d) from about 0.2 to about 0.7% by volume of beta hydroxy acid; and 2) providing a polishing solution comprised of:

(a) from about 80% to about 95% by volume of the spray solution; and (b) from about 5% to about 20% by volume of a 100% concentrated gel paste Nano crystal; and 3) Applying the polishing solution onto the cleaned hard floor surface; and 4) Toweling the applied polishing solution by interposing a clean, dry microfiber cloth between an underside of an oscillating machine and the hard floor surface for polishing the hard floor surface with the polishing solution and the microfiber cloth being driven by the oscillating machine in an oscillatory motion.

Typically, this process is repeated until a desired polished look is obtained.

Chemical Examples (Spray and Polish Chemistry)

Silicate Buffer

One example of the silicate buffer is sold under part number SS212 and under the TRADE NAME: SILMIX by MIXA CO., LTD., 338, Shinjuku, Shinjuku-Ku, Tokyo, Japan, 224444.

Alpha and Beta Hydroxy Acids

One example of the Alpha and Beta Hydroxy Acids are respectively sold under part numbers SP1A and SP1B and under the TRADE NAMES: SCIPHAR A & SCIPHAR B by Tianjin Pharma Tech Co., Ltd., 111 HuangHai Road 1EDA Tianjin, P. R. China.

100% Concentrated Gel Paste Nano Crystal

One example of the 100% concentrated gel paste Nano crystal is sold under part number V2HS and under the TRADE NAME: ALODUR by Hennes Schleifinittel GmbH & Co. KG, Luruper Hauptstrasse, Hamburg, Gennany, 22547.

Chemistry (Protecting Chemistry)

In one embodiment, the hard floor surface care process 10 comprises a protecting process for protecting the hard floor surface after polishing, said protecting process comprising:

1) selecting, as a function of the identifying step, a protecting chemistry from the group consisting of:

from about 96.4% to about 98.0% by volume of a aqueous or water based carrier combined with from about 1.7% to about 2.3% by volume of a fluoropolymer, and from about 97.4 to about 98.5% by volume of a petro solvent based carrier combined with from about 1.6 to about 2.1% by volume of a fluoropolymer;

2) Wherein, the protecting chemistry in the form of the water based carrier combined with the fluoropolymer is selected when the hard floor surface is identified as acid nonreactive; and 3) Wherein the protecting chemistry in the form of the petro solvent based carrier combined with the fluoropolymer is selected when the hard floor surface is identified as acid reactive; and 4) Applying the selected protecting chemistry; and 5) Toweling the applied selected protecting chemistry by interposing a clean, dry microfiber or cotton cloth between an underside of an oscillating machine and the hard floor surface with the microfiber or cotton cloth being driven by the oscillating machine in an oscillatory motion.

Aqueous Carrier

An examples of Aqueous Carrier is sold under part number 53501 and under the TRADE NAME: GTS by ZHEJIANG WHI CO., LTD., $5^{th}$ Siyan Rd, Quzhou, Zhejiang, China, 201202

Petro Based Carrier

One example of the Petro Based Carrier is sold under part number WS and under the TRADE NAME: WHITE SPIRIT by Sorurcemull Sarl., Karl Mars Stress., Frankfurt, Oder, Germany, 53420.

Fluoropolymer

Examples of Fluoropolymer are as follows: A FluoroPolymer sold under part number WINTFLON and under the TRADE NAME: ANWIN by ANWIN TECHNOLOGY CO., LTD., 11-3FL., No. 171, Nan King E. Rd. Sec. 4, Taipei, Taiwan, 10579. A FluoroPolymer is sold under part number TE601 and under the TRADE NAME: TFEP by Thanavala Enterprise, 102, Krishna Kunj, 143, S. B. Marg, Mumbai-400 016, Maharashtra, INDIA. A FluoroPolymer is sold under part number PF101 and under the TRADE NAME: OSMOTEX by P.A.T.I. S.P.A., Via Beltramini 50-52, San Zenone Degli Ezzelini, TV, Italy, 31020. A FluoroPolymer is sold under part number HZR-003 and under the TRADE NAME: HUZHENG by Shanghai Huzheng Co, Ltd., No. 1151 liaxi Road, No. 5 Building, Floor 3, Shenghia, China, 201204.

Approximate or About

The word "approximately" or "about" in the context herein are not indefinite. A person skilled in the art would understand these words to mean a value that is close to, but not necessarily exactly the same as, the stated value. Moreover, any measured amount is, by definition, approximate or about, as the measurement is only as good as the measuring device. Every measuring device has a margin of error such that every measurement includes the margin of error of the device used to make the measurements. Thus, ""approximately" or "about" in the context herein would be understood to include at least the margin of error of the measuring device.

Rubber Compound Floor Surface Care Process

One particular utilization of the hard floor surface care process 10 is in the form a rubber or rubber like compound floor surface care process.

In this embodiment, the hard floor surface care process comprises heating (from about 140 to about 150 degrees Fahrenheit) a water selected from the group consisting of a buffered distilled water having a pH of about 7 and a buffered soft water having a pH of about 7 to agitate molecule activity of the selected water.

Then, forming an emulsifying solution by mixing the selected water with a chemistry buffered to a pH of about 7, the chemistry comprising alpha and beta hydroxy acids and enzymes.

Then, applying the emulsifying solution onto a selected area of the hard floor surface to be cleaned.

Next, pad agitating the hard floor surface with the emulsifying solution applied thereto by interposing a rubber or rubber like pad between an underside of the oscillating machine and over the emulsifying solution applied on the hard floor surface with the pad being driven by the oscillating machine in an oscillatory motion for dislodging contaminates from the hard floor surface.

And, toweling the hard floor surface by interposing a clean, dry cotton cloth between an underside of the oscillating machine and the hard floor surface for absorbing the dislodged contaminates while drying the hard floor surface with the cotton cloth being driven by the oscillating machine in an oscillatory motion.

Additionally, and in one embodiment, the above process includes agitating is by brushing the hard floor surface with the emulsifying solution applied thereto prior to pad agitating the hard floor surface with the emulsifying solution applied thereto for dislodging contaminates from the hard floor surface.

Furthermore, and in one embodiment, the hard floor surface is a rubber compound.

Moreover, and in one embodiment, the above process includes a polishing process comprising:

1) Providing a lubricating solution comprised of: (a) about 96.3 to about 97.9% by volume of the selected water; (b) about 1.1 to about 2.0% by volume of the silicate buffer; (c) about 0.5 to about 1.1% by volume of alpha hydroxy acid; (d) about 0.2 to about 0.7% by volume of beta hydroxy acid.

2) Next, applying the lubricating solution onto the cleaned hard floor surface.

3) Then, polishing the hard floor surface by interposing a rubber or rubber like pad between an underside of the oscillating machine and over the applied solution on the hard floor surface with the pad being driven by the oscillating machine in an oscillatory motion for polishing the hard floor surface.

4) And, toweling the hard floor surface by interposing a clean, dry microfiber cloth between an underside of the oscillating machine and the hard floor surface with the microfiber cloth being driven by the oscillating machine in an oscillatory motion for further polishing the hard floor surface with the microfiber cloth and absorbing the presence of applied lubricating solution.

It will be apparent to those skilled in the art that various modifications and variations can be made to the processes of this invention without departing from the scope or the spirit of this invention. In view of the foregoing, it is intended that this invention cover modifications and variations provided they fall within the scope of the following claims and their equivalents.

I claim:

1. A hard floor surface care process, said process consisting of:

heating a selected water;

mixing the selected water with a chemistry to form a heated cleaning fluid, the chemistry consisting of alpha and beta hydroxy acids and enzymes;

applying the heated cleaning fluid onto a selected area of the hard floor surface to be cleaned;

optionally, agitating the hard floor surface with the heated cleaning fluid applied thereto for dislodging contaminates from the hard floor surface; and optionally, toweling the hard floor surface by interposing a clean, dry cotton cloth between an underside of an oscillating machine and the hard floor surface for absorbing the dislodged contaminates while drying the hard floor surface with the cotton cloth being driven by the oscillating machine in an oscillatory motion.

2. The process of claim 1 further consisting of agitating the hard floor surface with the heated cleaning fluid applied thereto for dislodging contaminates from the hard floor surface.

3. The process of claim 1 further consisting of toweling the hard floor surface by interposing a clean, dry cotton cloth between an underside of an oscillating machine and the hard floor surface for absorbing the dislodged contaminates while drying the hard floor surface with the cotton cloth being driven by the oscillating machine in an oscillatory motion.

4. The process of claim 1 wherein the selected water is selected from the group consisting of a buffered distilled water having a pH of about 7 and a buffered soft water having a pH of about 7.

5. A hard floor surface care process, said process consisting of:

heating water;

forming an emulsifying solution by mixing the heated water with a chemistry, the chemistry consisting of alpha and beta hydroxy acids and enzymes; and applying the emulsifying solution onto a selected area of the hard floor surface to be cleaned.

* * * * *